US006978840B2

(12) United States Patent
Henderson

(10) Patent No.: US 6,978,840 B2
(45) Date of Patent: Dec. 27, 2005

(54) WELL SCREEN ASSEMBLY AND SYSTEM WITH CONTROLLABLE VARIABLE FLOW AREA AND METHOD OF USING SAME FOR OIL WELL FLUID PRODUCTION

(75) Inventor: William D. Henderson, Tioga, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 33 days.

(21) Appl. No.: 10/358,958

(22) Filed: Feb. 5, 2003

(65) Prior Publication Data

US 2004/0149435 A1 Aug. 5, 2004

(51) Int. Cl.[7] ..... E21B 43/08
(52) U.S. Cl. ..... 166/380; 166/296; 166/51
(58) Field of Search ..... 166/380, 277, 166/229, 235, 236, 296, 332.4, 334.4, 51, 205, 227, 228

(56) References Cited

U.S. PATENT DOCUMENTS

| | | | |
|---|---|---|---|
| 2,280,054 | A | 4/1942 | Beck |
| 2,342,913 | A | 2/1944 | Williams et al. |
| 2,344,909 | A | 3/1944 | Williams et al. |
| 3,005,507 | A | 10/1961 | Clark Jr. et al. |
| 3,486,558 | A | 12/1969 | Maxwell |

(Continued)

FOREIGN PATENT DOCUMENTS

| | | |
|---|---|---|
| EP | 0 431 162 | 6/1991 |
| EP | 0 617 195 | 9/1994 |
| EP | 1 132 571 | 9/2001 |
| EP | 0 955 447 | 3/2004 |
| FR | 2 543 213 | 3/1983 |

(Continued)

OTHER PUBLICATIONS

U.S. Appl. No. 10/525,621, Unpublished, Brezinski et al.

Restarick; "Mechanical Fluid–Loss Control Systems Used During Sand Control Operations"; 1992; pp. 21–36.

"Sand Control Screens"; Halliburton Energy Services; 1994; 4 pages.

Ebinger; "Frac pack technology still evolving"; Oil & Gas Journal; Oct. 23, 1995; pp. 60–70.

Hailey et al.; "Screenless Single Trip Multizone Sand Control Tool System Saves Rig Time"; 2000 SPE International Synposium on Formation Damage Control; Feb. 2000; pp. 1–11.

"CAPS Sand Control Service for Horizontal Completions Improves Gravel Pack Reliability and Increases Production Potential From Horizontal Completions"; Halliburton Energy Services, Inc.; Aug. 2000; 2 pages.

"CAPS Concentric Annular Packing Service for Sand Control"; Halliburton Energy Services, Inc.; Aug. 2000; 4 pages.

(Continued)

*Primary Examiner*—Frank Tsay
(74) *Attorney, Agent, or Firm*—Lawrence R. Youst

(57) ABSTRACT

A well screen assembly (70) with a controllable variable flow area. The well screen assembly (70) comprises an outer tubular section (80), the outer tubular section (80) containing a first plurality of openings (90) disposed in a pattern (100) throughout a length "L" of the outer tubular section (80); an inner tubular section (110) that is disposed within the outer tubular section (80), the inner tubular section (110) containing a second plurality of openings (120) disposed in the same pattern (100) throughout a length L of the inner tubular section (110), and when the first plurality of openings (90) and second plurality of openings (120) align, the openings form a plurality of passageways (130) through the outer tubular section (80) and inner tubular section (110). The well screen assembly (70) may therefore, vary the flow of production fluid through it and upwards through the interior of a production tubing (40).

39 Claims, 11 Drawing Sheets

U.S. PATENT DOCUMENTS 3,627,046 A 12/1971 Miller et al.
3,865,188 A 2/1975 Doggett et al.
3,993,130 A 11/1976 Papp
4,102,395 A 7/1978 Robinson
4,103,741 A 8/1978 Daigle
4,418,754 A 12/1983 Stepp
4,428,428 A 1/1984 Smyrl et al.
4,494,608 A 1/1985 Williams et al.
4,553,595 A 11/1985 Huang et al.
4,558,742 A 12/1985 Huang et al.
4,627,488 A 12/1986 Szarka
4,646,839 A 3/1987 Rickey
4,858,690 A 8/1989 Rebardi et al.
4,886,432 A 12/1989 Kimberlin
4,932,474 A 6/1990 Schroeder, Jr. et al.
4,945,991 A 8/1990 Jones
5,082,052 A 1/1992 Jones et al.
5,111,883 A 5/1992 Savery
5,113,935 A 5/1992 Jones et al.
5,161,613 A 11/1992 Jones
5,161,618 A 11/1992 Jones et al.
5,165,476 A 11/1992 Jones
5,228,526 A 7/1993 Vshivkov et al.
5,332,038 A * 7/1994 Tapp et al. ..... 166/278
5,332,039 A 7/1994 Primeaux et al.
5,333,688 A 8/1994 Jones et al.
5,333,689 A 8/1994 Jones et al.
5,343,949 A 9/1994 Ross et al.
5,355,953 A 10/1994 Shy et al.
5,355,956 A 10/1994 Restarick
5,386,874 A 2/1995 Laramay et al.
5,390,966 A 2/1995 Cox et al.
5,417,284 A 5/1995 Jones
5,419,394 A 5/1995 Jones
5,435,391 A 7/1995 Jones
5,435,393 A 7/1995 Brekke et al.
5,443,117 A 8/1995 Ross
5,476,143 A 12/1995 Sparlin et al.
5,515,915 A 5/1996 Jones et al.
5,551,513 A * 9/1996 Surles et al. ..... 166/278
5,560,427 A 10/1996 Jones
5,588,487 A 12/1996 Bryant
5,636,691 A 6/1997 Hendrickson et al.
5,676,208 A 10/1997 Finley
5,690,175 A 11/1997 Jones
5,699,860 A 12/1997 Grundmann
5,722,490 A 3/1998 Ebinger
5,730,223 A * 3/1998 Restarick ..... 166/380
5,755,286 A 5/1998 Ebinger
5,842,516 A 12/1998 Jones
5,848,645 A 12/1998 Jones
5,865,251 A 2/1999 Rebardi et al.
5,868,200 A 2/1999 Bryant et al.
5,890,533 A 4/1999 Jones
5,896,928 A * 4/1999 Coon ..... 166/373
5,906,238 A 5/1999 Carmody et al.
5,921,318 A 7/1999 Ross
5,934,376 A 8/1999 Nguyen et al.
5,988,285 A 11/1999 Tucket et al.
6,003,600 A 12/1999 Nguyen et al.
6,047,773 A 4/2000 Zeltmann et al.
6,059,032 A 5/2000 Jones
6,112,815 A 9/2000 Bøe
6,112,817 A 9/2000 Voll et al.
6,116,343 A 9/2000 Van Petegem et al.
6,125,933 A 10/2000 Ross
6,220,345 B1 4/2001 Jones et al.
6,220,357 B1 4/2001 Carmichael et al.
6,227,303 B1 5/2001 Jones
6,230,803 B1 5/2001 Morton et al.
6,276,458 B1 8/2001 Malone et al.
6,286,594 B1 9/2001 French
6,302,208 B1 10/2001 Walker et al.
6,325,150 B1 12/2001 Rayssiguier
6,343,651 B1 2/2002 Bixenman
6,371,208 B1 4/2002 Norman et al.
6,371,210 B1 4/2002 Bode et al.
6,394,184 B2 5/2002 Tolman et al.
6,397,950 B1 6/2002 Streich et al.
6,405,800 B1 6/2002 Walker et al.
6,427,775 B1 8/2002 Dusterhoft et al.
6,446,722 B2 9/2002 Nguyen et al.
6,446,729 B1 9/2002 Bixenman et al.
6,450,263 B1 9/2002 Schwendemann
6,457,518 B1 10/2002 Castano-Mears et al.
6,464,007 B1 10/2002 Jones
6,478,091 B1 11/2002 Gano
6,481,494 B1 * 11/2002 Dusterhoft et al. ..... 166/51
6,488,082 B2 * 12/2002 Echols et al. ..... 166/51
6,494,261 B1 12/2002 Pahmiyer
6,494,265 B2 12/2002 Wilson et al.
6,516,881 B2 2/2003 Hailey, Jr.
6,516,882 B2 2/2003 McGregory et al.
6,540,022 B2 4/2003 Dusterhoft et al.
6,543,538 B2 4/2003 Tolman et al.
6,547,011 B2 4/2003 Kilgore
6,557,634 B2 5/2003 Hailey, Jr. et al.
6,557,635 B2 5/2003 Nguyen et al.
6,571,872 B2 6/2003 Dusterhoft et al.
6,581,689 B2 6/2003 Hailey, Jr.
6,588,506 B2 7/2003 Jones
6,588,507 B2 7/2003 Dusterhoft et al.
6,601,646 B2 8/2003 Streich et al.
6,622,794 B2 9/2003 Zisk, Jr.
6,644,406 B1 11/2003 Jones
6,644,412 B2 11/2003 Bode et al.
6,675,891 B2 * 1/2004 Hailey et al. ..... 166/228
6,681,854 B2 1/2004 Danos
6,695,054 B2 2/2004 Johnson et al.
6,702,018 B2 3/2004 McGregor et al.
6,702,019 B2 3/2004 Dusterhoft et al.
6,715,545 B2 4/2004 McGregor et al.
6,719,051 B2 4/2004 Hailey, Jr. et al.
6,745,843 B2 6/2004 Johnson et al.
6,786,285 B2 9/2004 Johnson et al.
6,857,476 B2 2/2005 Richards
6,886,634 B2 5/2005 Richards
6,899,176 B2 5/2005 Hailey, Jr. et al.
2002/0074119 A1 6/2002 Bixenman et al.
2002/0092649 A1 7/2002 Bixerman et al.
2002/0096329 A1 7/2002 Coon et al.
2002/0125006 A1 9/2002 Hailey, Jr. et al.
2002/0125008 A1 9/2002 Wetzel et al.
2002/0157837 A1 10/2002 Bode et al.
2002/0174981 A1 11/2002 Den Boer et al.
2002/0189815 A1 12/2002 Johnson et al.
2003/0000701 A1 1/2003 Dusterhoft et al.
2003/0000875 A1 1/2003 Echols et al.
2003/0056947 A1 3/2003 Cameron
2003/0056948 A1 3/2003 Cameron
2003/0075324 A1 4/2003 Dusterhoft et al.
2003/0089496 A1 5/2003 Price-Smith et al.
2003/0141061 A1 7/2003 Hailey, Jr. et al.
2003/0141062 A1 7/2003 Cowan et al.
2003/0183386 A1 10/2003 McGregor et al.
2003/0188871 A1 10/2003 Dusterhoft et al.
2004/0020832 A1 2/2004 Richards et al.
2004/0035578 A1 2/2004 Ross et al.
2004/0035591 A1 2/2004 Echols
2004/0173350 A1 9/2004 Wetzel et al.

FOREIGN PATENT DOCUMENTS

GB 2371319 1/2002
GB 2 371 578 7/2002
GB 2 381 021 4/2003
GB 2 381 811 5/2003
WO WO 99/12630 3/1999
WO WO 00/61913 10/2000
WO WO 01/14691 3/2001

| | | |
|---|---|---|
| WO | WO 01/42620 | 6/2001 |
| WO | WO 01/44619 | 6/2001 |
| WO | WO 01/49970 | 7/2001 |
| WO | WO 02/10554 | 2/2002 |
| WO | WO 02/055842 | 7/2002 |
| WO | WO 02/057594 | 7/2002 |
| WO | WO 03/023185 | 3/2003 |

OTHER PUBLICATIONS

Saldungaray et al.; "Simultaneous Gravel Packing and Filter Cake Removal in Horizontal Wells Applying Shunt Tubes and Noval Carrier and Breaker Fluid"; Mar. 2001; pp. 1–6.

"OSCA Screen Communication System"; 1 page; Technical Bulletin.

"OSCA Pressure Actuated Circulating Valve"; 1 page; Technical Bulletin.

"QUANTUM Zonal Isolation Tool"; pp. 12–13 of Sand Face Competions Catalog.

"Absolute Isolation System (ASI) Components"; Halliburton Energy Services, Inc.; p. 5–28 of Downhole Sand Control Components.

"OSCA HPR–ISO System"; Technical Bulletin; 1 page.

"OSCA The ISO System"; Technical Bulletin; 1 page.

Antonv et al.; "Database WPI"; Derwent Publications Ltd., London; Jul. 17, 1982; 1 page.

* cited by examiner

WELL SCREEN ASSEMBLY AND SYSTEM WITH CONTROLLABLE VARIABLE FLOW AREA AND METHOD OF USING SAME FOR OIL WELL FLUID PRODUCTION

TECHNICAL FIELD

The present invention relates generally to down-hole operations for oil and gas production and, more specifically, to the screening of production fluids to and from the production zones. Still more specifically, the invention relates to a system for controllably varying the flow area of a well screen assembly.

BACKGROUND OF THE INVENTION

Down-hole drilling and oil/gas production operations, such as those used to extract crude oil from one or more production zones in the ground, often utilize long lengths of production tubing to transmit fluids from great depths underneath the earth's surface to a well head above the surface. Such systems often use screens of various types to control the amount of particulate solids transmitted within the production fluid. It is well known that screens are designed to surround perforated portions of the production tubing or a perforated production sub, so that fluids and gases may enter the production tubing while leaving undesirable solids, such as formation sand, in the annulus. These screens may be used in either open-hole or cased-hole completions.

A disadvantage of current generation screens is the inability to control flow rate of the production fluid. Such screens operate as static devices in that they do not allow for an increase or decrease in the fluid flow area through the screen.

Other prior art screens have variable flow areas. A disadvantage of these screens is their relatively small flow area, which can lead to a reduced rate of production fluid flow.

Another disadvantage associated with some prior art screens is the requirement that flapper valves be used to control fluid loss prior to production. Flapper valves are prone to cracking or breaking such that pieces of the flapper valves may be introduced into areas of the well causing damage or interfere with various well components such as, for example, the chokes, sensors and other devices, in the well.

Still another disadvantage associated with some prior art screens is the use of ball sealers to shut off perforations through which excessive fluid is being lost. The use of ball sealers require special running tools and ball catchers, which may restrict the wellbore thus reducing production. Additionally, ball sealers introduce additional complexity and cost to the oil production operation.

Considering the foregoing disadvantages associated with prior art screening systems, a cost effective non-intrusive means of achieving variable control of the flow area provided by a well screen would provide numerous advantages.

SUMMARY OF THE INVENTION

Disclosed is a well screen assembly with a controllable variable flow area. The well screen assembly comprises an outer tubular section with a first plurality of openings disposed in a pattern throughout a length of the outer tubular section. The well screen assembly also includes an inner tubular section that is engaged with and disposed about the outer tubular section, the inner tubular section containing a second plurality of openings disposed along the inner tubular section in a pattern similar to that of the first plurality of openings. In this way, the first plurality of openings and second plurality of openings can be aligned such that the openings form passageways through the outer tubular section and inner tubular section. By altering the relative position of one plurality of openings with respect to another plurality of openings, the invention can be used to vary the flow of production fluid through the well screen assembly and upwards through the interior of a production tubing. The invention can also be used to reduce or stop the back-flow of production fluid from the production tubing into production zones. In addition, the invention can also be used to reduce or stop the black-flow of production fluid leaving one or more production zones, going into the production tubing, and then back-flowing into one or more other production zone.

Also disclosed is a system for extracting production fluid from at least one production zone intersected by a wellbore. The system comprises production tubing extending along a substantial length of the wellbore and a well screen assembly coupled to the production tubing proximate to at least one production zone. A flow control device is operably coupled to the screen assembly to allow for the varying of the flow rate through the well screen assembly. In one embodiment, movement of the screen assembly is achieved by an actuator coupled to the assembly. The well screen assembly comprises an outer tubular section containing a first plurality of openings disposed in a pattern throughout a length of the outer tubular section and an inner tubular section that is engaged with and disposed within the outer tubular section, the inner tubular section containing a second plurality of openings disposed in the same pattern as the first plurality of openings. In this way, the flow control device can be used to align the first plurality of openings and second plurality of openings such that the openings form passageways through the outer tubular section and inner tubular section. By altering the relative position of one of the plurality of openings, the flow of production fluid through the well screen assembly and the interior of a production tubing may be varied.

Also disclosed is a method of varying the flow area of a well screen assembly in a production fluid extraction system having production tubing in a down-hole wellbore. The method comprises the steps of measuring a condition of the production fluid and converting the measured condition into an electrical signal. Next, the electrical signal is transmitted to a flow control device or to an operator or engineer at the surface for his or her review. A desired flow rate is calculated by the flow control device using the electrical signal or the operator or engineer may determine a desired flow rate based on the electrical signal. The flow control device transmits a signal to an actuator within the wellbore coupled to a well screen assembly according to the invention. In this way, the flow control device is capable of causing the actuator to alter the relative position of openings of the well screen assembly thereby controlling the flow rate of production fluid through the well screen assembly and through the interior of a production tubing.

An advantage of the present invention is the ability to vary the amount of fluid flow through a well screen assembly by changing the flow area of the well screen assembly from a maximum flow area to zero flow area.

Another advantage of the present invention is that it allows for a relatively large flow area as compared to prior art well screens.

Another advantage of the present invention is that it allows for the shutting off of water producing zones. Water producing zones can be shut off by decreasing or closing the flow area in the disclosed screens adjacent to the water producing zones, while keeping open the flow area of the disclosed screens adjacent to the non-water (or low-water) producing zones.

Another advantage of the present invention is that it allows for the shutting off of producing zones, to thereby allow treatment of poorly producing zones, or non-producing zones. Thus, the disclosed screens adjacent to producing zones may be closed. Then various treating materials, such as, but not limited to, acids, chemicals and proppants may be pumped into the non-producing zones of the well.

Another advantage of the present invention is the elimination of the need for flappers and balls to achieve fluid flow control. The present invention overcomes the problems associated with broken flapper pieces becoming lodged in the well, and the reduced production flow areas, as well as the complexities and costs associated with well screen balls.

Another advantage of the present invention is that it may variably introduce an increased pressure drop adjacent one or more production zones, thereby allowing for a more equal production of fluids from various production zones in the wellbore.

BRIEF DESCRIPTION OF THE DRAWINGS

The above advantages as well as specific embodiments will be understood from consideration of the following detailed description taken in conjunction with the appended drawings in which.

References in the detailed description correspond to like references in the figures unless otherwise indicated.

DETAILED DESCRIPTION OF THE PREFERRED EMBODIMENTS

The present invention provides a well screen assembly and system with controllable variable flow area and method for using the same to control the flow of production fluid, such as crude oil, from one or more production zones underneath the earth's surface, upwards through the interior of production tubing. The present invention may also be used to limit or stop the flow of production fluid from the production tubing and back into the production zones. The disclosed invention may further be used to vary the amount of production fluid loss resulting from back-flow from the production tubing into the production zones.

Figure 1:
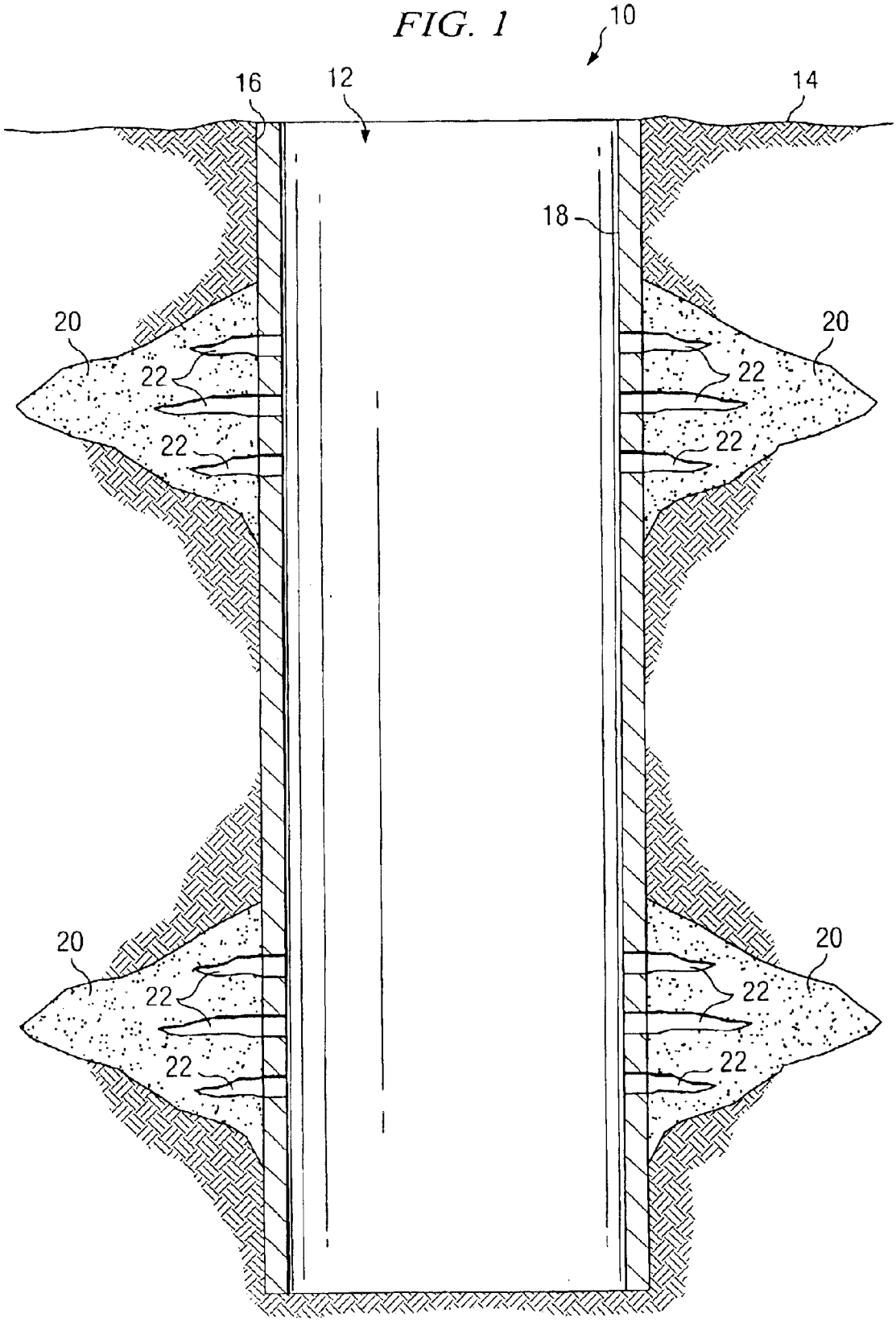
FIG. 1 is a figure illustrating a typical wellbore intersecting a plurality of production zones.

With reference now to the figures, and in particular to FIG. 1, there is shown a typical down-hole operation, denoted generally as 10, in which the present invention may be utilized. In essence, the down-hole operation 10 provides an excavation underneath the earth's surface 14 which is created using well known techniques in the energy industry. The operation 10 includes a wellbore 12 with wall 16 lined with casing 18 which has a layer of cement between the wellbore 12 and the casing 18 such that a hardened shell is formed along the interior of the wellbore 12. For convenience, the singular and plural of a term ("passageway" and "passageways", "zone" or "zones", "sleeve" or "sleeves", "packer" or "packers", etc . . . ) will be used interchangeable throughout and with the same reference number associated with both forms of the term. Although a casing 18 is shown in FIG. 1, it is not necessary to this invention. The invention may be used in open-hole completion.

FIG. 1 also shows a plurality of production zones 20 in which drilling operations are concentrated for the extraction of oil. Each production zone 20 is shown to have one or more passageways 22 leading from the production zone 20 to the interior of the wellbore 12. The passageways 22 allow a flow of fluid from a production zone 20 into the wellbore 12 for extraction using methods known to those of ordinary skill. Typically, the excavation of a wellbore, such as wellbore 12, is a time consuming and costly operation and involves the drilling underneath the surface 14 to great depths. Therefore, it is expected that the wellbore 12 will be utilized for a relatively long period of time such that the operator or engineer can justify the investment in time and money.

Figure 2:
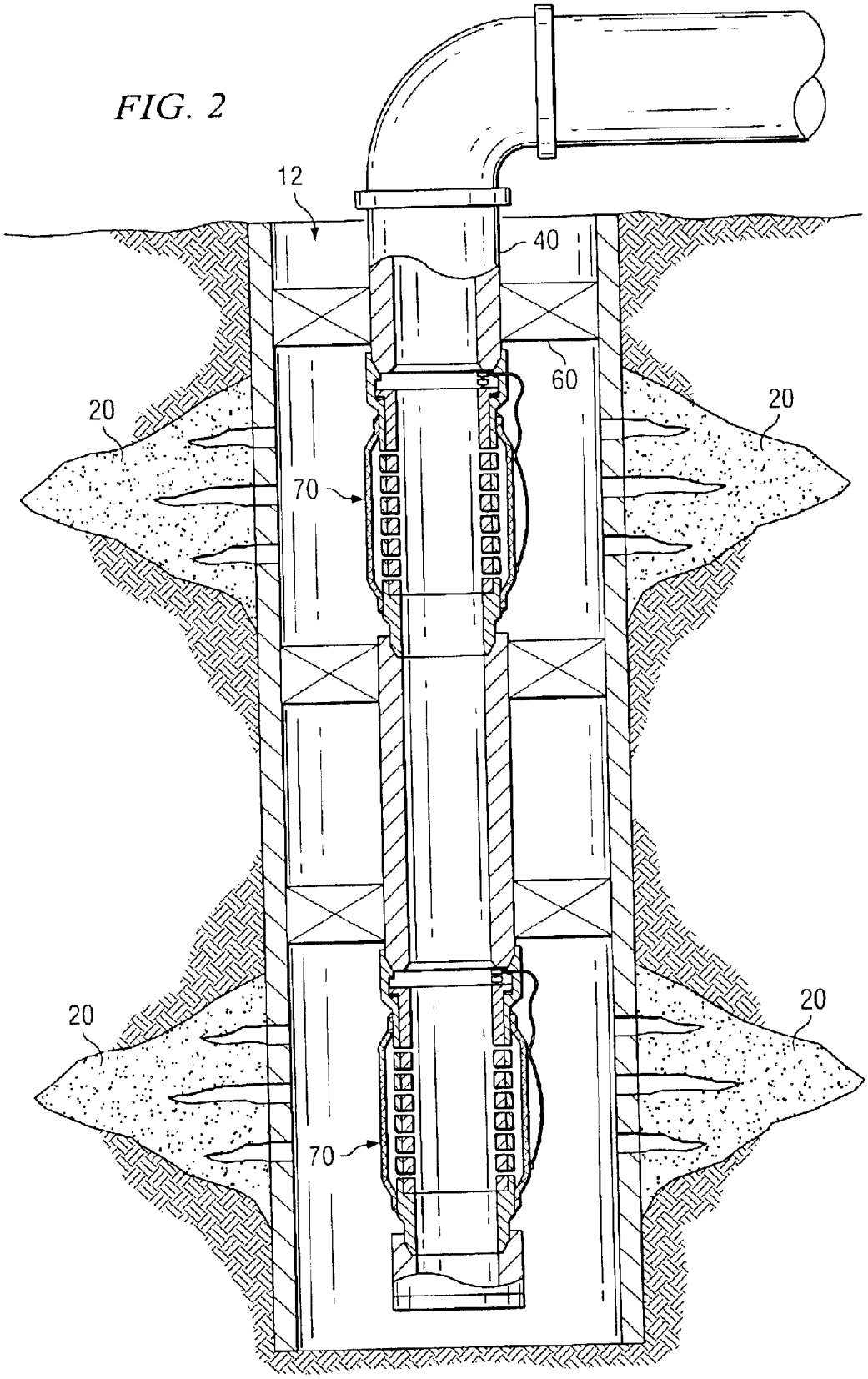
FIG. 2 shows a down-hole operation with production tubing installed.

Turning now to FIG. 2, therein is shown an example down-hole operation with production tubing 40 and a couple of well screen assemblies 70 according to the invention. As shown, the well screen assemblies 70 are installed within the wellbore 12 about the production tubing 40 forming a fluid screen and conduit system for filtering and extracting fluids from the production zones 20. In a typical installation, multiple well screen assemblies 70 would be used allowing independent screening and flow control (as explained below) of production zones 20 of the wellbore 12. The well screen assemblies 70 are used to screen out or filter undesirable solid materials that may be contained in the production fluid to be extracted. As discussed and illustrated herein, the presently disclosed well screen assemblies 70 are designed such that their flow area can be adjusted such that the flow of production fluid may be varied from a maximum flow to a no-flow or shut-off condition thereby providing fluid flow control in the screening function. For convenience the terms "assembly" and "assemblies" will be used interchangeably. As shown, each well screen assembly 70 is being contained in an area defined by packers 60, the use of which are well known in the industry. The physics governing the flow of fluids from a production zone 20 through the production tubing 40 is also well known.

Figure 3A:
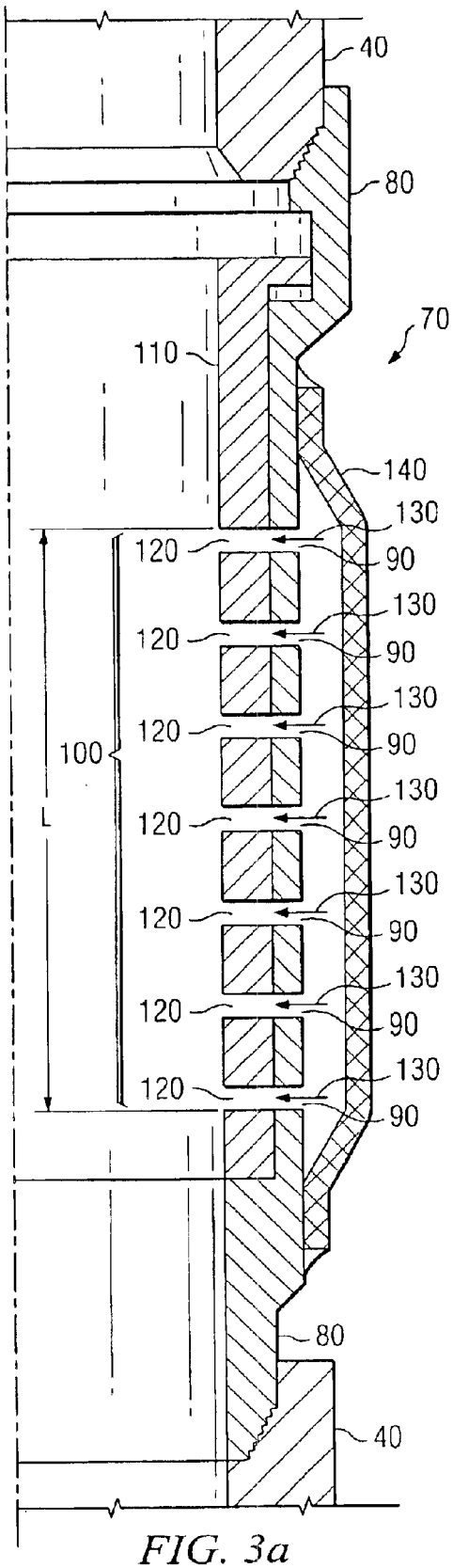
FIGS. 3*a*, 3*b*, and 3*c* are one-half cross-sectional views of a well screen assembly according to the present invention.
Figure 3B:
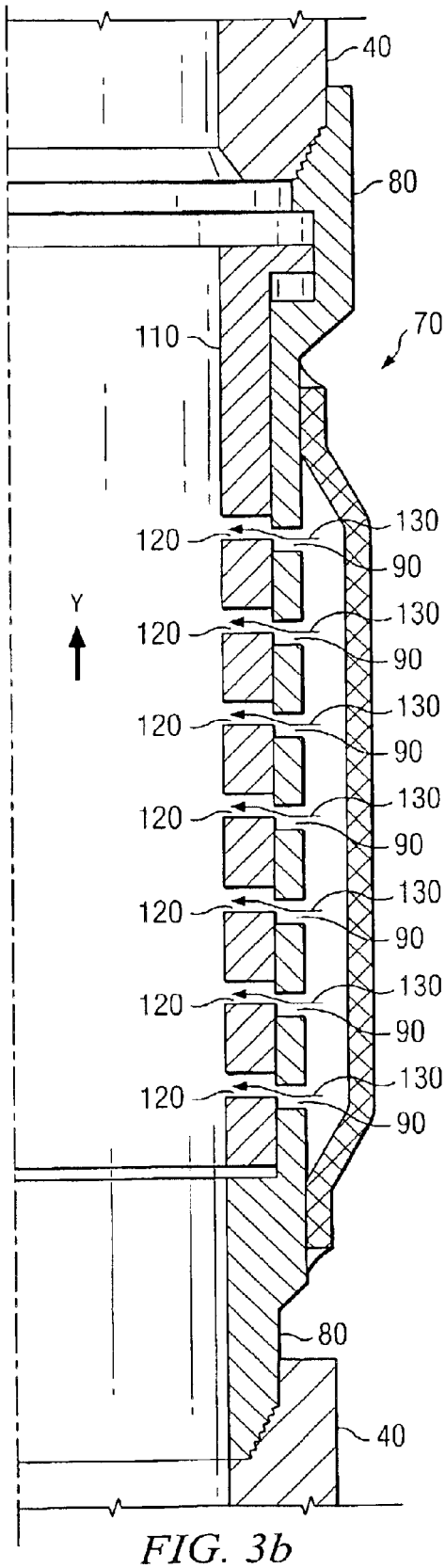
Figure 3C:
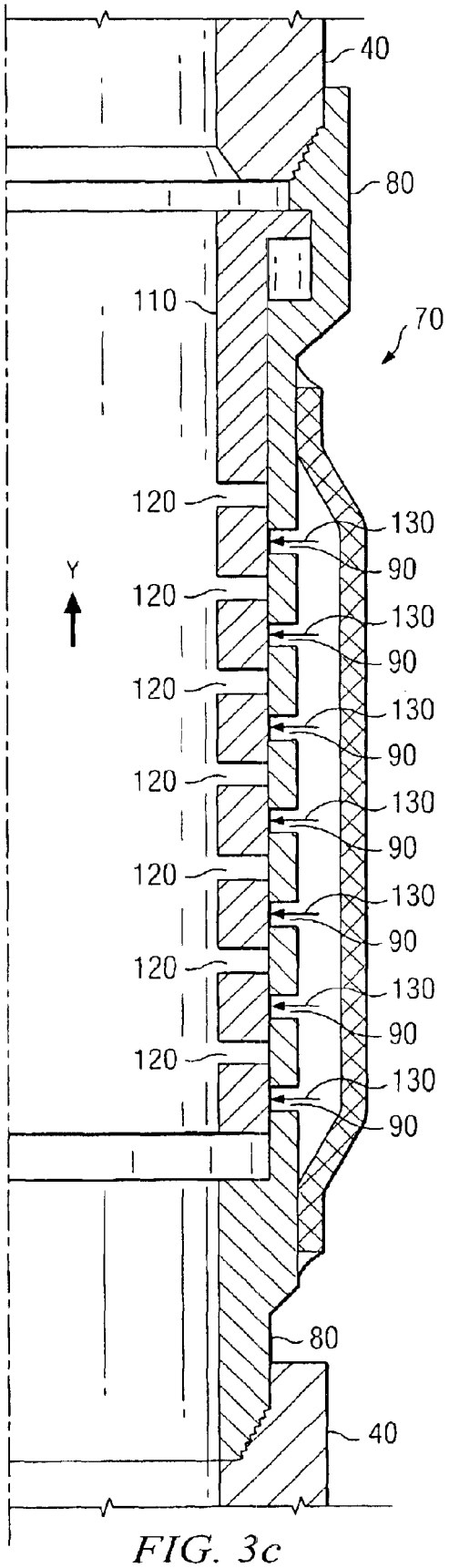

Referring now to FIG. 3*a*, a cross-sectional view of the well screen assembly 70 according to the invention is shown. In short, the well screen assembly 70 provides a controllable variable flow area that can be varied by the operator or engineer to adjust fluid flow through the well screen assembly 70. The well screen assembly 70 includes an outer tubular section 80 containing a plurality of openings 90 disposed in a pattern 100 throughout a length "L" of the outer tubular section 80. An inner tubular section 110 is engaged with and movably disposed within the outer tubular section 80. In FIGS. 3*a*–3*c*, the inner tubular section 110 is shown to be linearly movable with respect to the outer tubular section 80. In other words, inner tubular section 110 moves in an axial and linear direction relative to outer tubular section 80. Alternatively, in FIGS. 4*a*–4*b*, the inner tubular section 110 is shown to be rotatable within the outer tubular section 80. The inner tubular section 110, like the outer tubular section 80, includes a plurality of openings 120. The openings 120 are disposed throughout a length "L" and form the same pattern 100 as the openings 90 of the outer tubular section 80. This arrangement provides 2 sets of openings that can cross each other to form an overall opening that depends on the amount of overlap between openings 90 and openings 120. Thus, when openings 90 and openings 120 are aligned with each other so that an overall opening exists, passageways 130 are formed (indicated by the arrows) through the outer tubular section 80 and inner tubular section 110. In this way, fluid is capable of flowing through passageways 130. The inner tubular section 110 and outer tubular section 80 are shown such that openings 90 and 120 create fully opened passageways 130 corresponding to the maximum fluid flow condition.

Still referring to FIG. 3*a*, a screen jacket 140 is shown coupled to the outer tubular section 80 and is comprised of a porous material that permits fluid flow into passageways 130. Screen jacket 140 provides a first screening function that inhibits the flow of large debris into the screen assembly 70. In this regard various screen jacket configurations may be used as are well known in the arts.

Figure 4A:
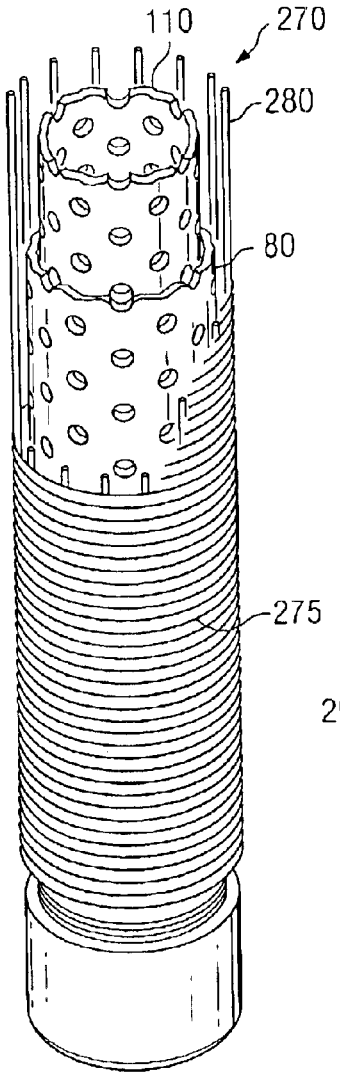
FIGS. 4*a*, 4*b* and 4*c* are perspective drawings of screen jackets.

One screen jacket configuration is the wire-wrapped jacket 270 shown in FIG. 4*a*. Shown are the outer tubular section 80 and the inner tubular section 110. This particular screen assembly may have a keystone-shaped wire 275 on ribs 280 welded to the outer tubular section 80.

Figure 4B:
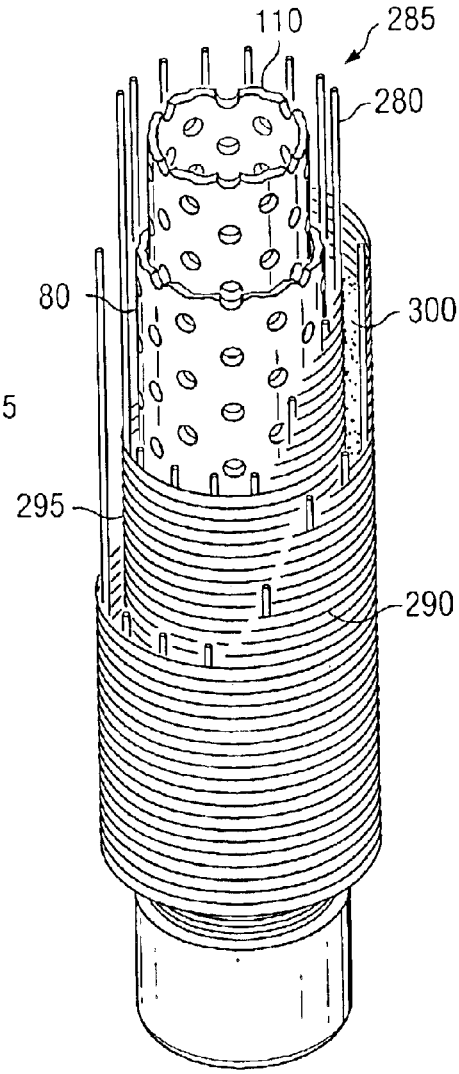

Another screen jacket configuration is the dual-screen prepack screen jacket 285 show in FIG. 4*b*. Outer tubular section 80 and inner tubular section 110 are again present. The dual-screen prepack screen jacket comprises an outer screen jacket 290 and an inner screen jacket 295. Aggregate material 300 is shown between the outer screen jacket 290 and inner screen jacket 295.

Figure 4C:
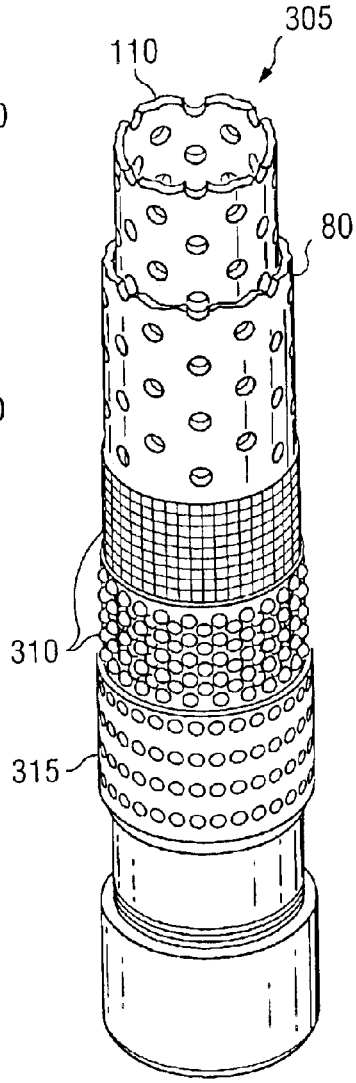

Shown in FIG. 4*c* is a screen jacket 305 comprising a sintered laminate filter media 310 and a protective shroud 315. Also shown are the outer tubular section 80 and inner tubular section 110. Halliburton Energy Services manufactures sintered laminate filter media screen under the Poroplus® name.

Referring now to FIG. 3*b*, inner tubular section 110 is shown having been linearly moved upwards in the direction of the arrow "Y" within outer tubular section 80. This type of movement decreases the flow area through the passageways 130 as openings 90 and 120 are no longer in complete alignment, but are only partially aligned. In this way, the well screen assembly 70 can be used to reduce the flow of production fluid through the passageways 130 of well screen assembly 70, without a total stoppage of flow.

Referring now to FIG. 3*c*, inner tubular section 110 is shown having been linearly moved a greater amount upwards in the direction of arrow "Y" relative to outer tubular section 80. This movement has decreased the flow area to a point that passageways 130 are now closed. Thus, passageways 130 are closed due to the relative position of openings 120 to openings 90 such that no flow is permitted through the well screen assembly 70. This corresponds to a no-flow or shut-off condition of the well screen assembly 70.

Figure 5A:
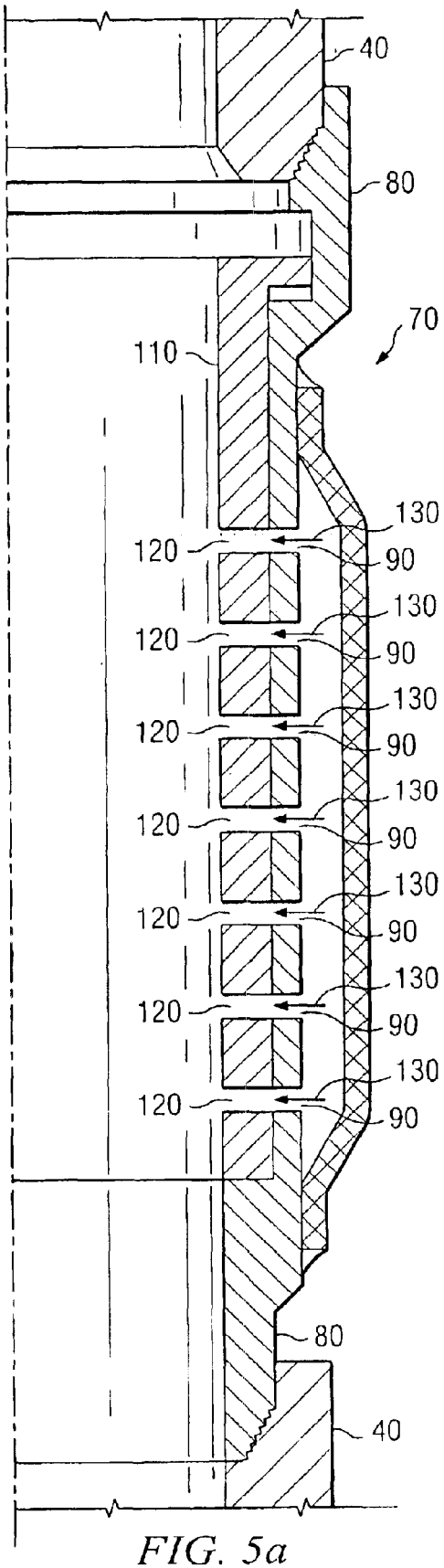
FIGS. 5*a* and 5*b* are one-half cross-sectional views of a well screen assembly according to another embodiment the present invention.

Referring now to FIG. 5*a*, another embodiment of the well screen assembly 70 according to the invention is shown. In this embodiment, the inner tubular section 110 does not move up and down with respect to outer tubular section 80, but rather rotates within outer tubular section 80. The well screen assembly 70 is shown in an aligned position, with openings 90 aligned with openings 120. The aligned openings 90 and 120 form passageways 130.

Figure 5B:
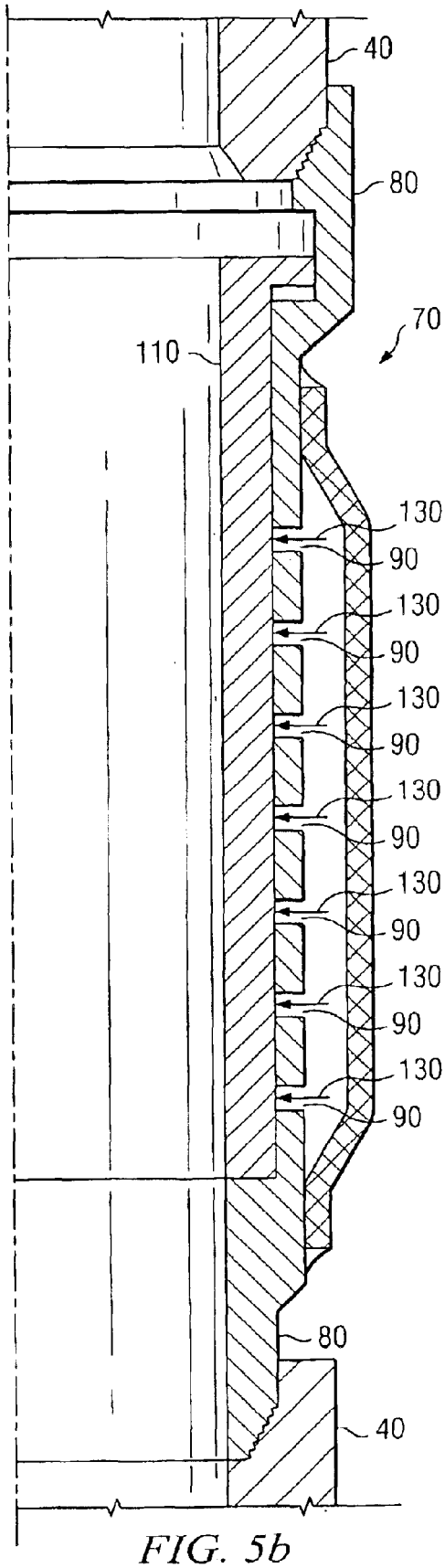

Referring now to FIG. 5*b*, inner tubular section 110 is shown having been rotated an amount relative to outer tubular section 80. Rotation has caused the openings 90 in the outer tubular section 80 to be lined up with a portion of the inner tubular section 110 which has no openings, thereby closing passageways 130, and preventing any flow of production fluid. Of course, the inner tubular section 110 may be rotated such that the passageways 130 are only partially blocked, thereby increasing the flow area through passageways 130 from a minimum flow to full flow. In this way, the well screen assembly 70 can be used to vary the flow of production fluid through the flow areas defined by passageways 130 from a no-flow to maximum flow. This is an advantage over prior art screen assemblies where full variance in the flow area could not be achieved.

Figure 6A:
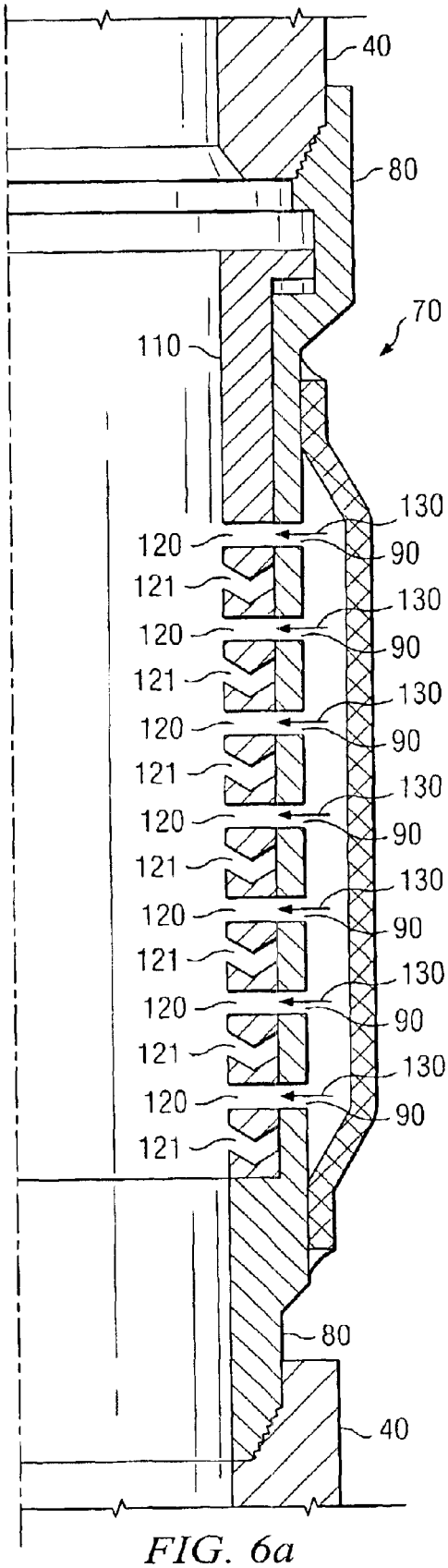
FIGS. 6*a* and 6*b* are one-half cross-sectional views of a well screen assembly illustrating the tortuous passageways.

Referring now to FIG. 6*a*, another embodiment of the well screen assembly 70 according to the invention is shown. In this embodiment, the inner tubular section 110 has openings 120 and in addition, openings 121. Openings 120 are shown aligned with openings 90, thereby forming straight passage ways 130 for the production fluid.

Figure 6B:
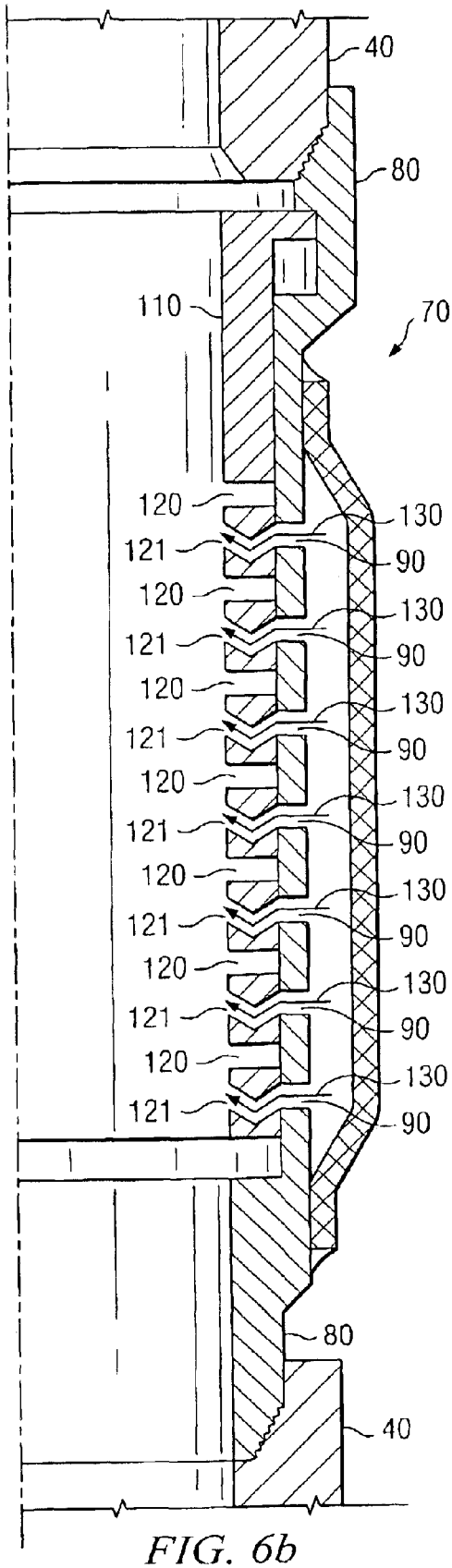

Referring now to FIG. 6*b*, inner tubular section 110 is shown having been moved linearly upward such that openings 121 are now aligned with openings 90 of outer tubular section 80. The passageways formed, are now tortuous passageways 130. These tortuous passageways 130 will create a pressure drop in the production fluid as compared to the straight passageways 130 shown in FIG. 6*a*. This pressure drop may be useful in wellbores with multiple production zones, where there are uneven rates of production from the production zones. These different rates may cause problems in the total production of the wellbore, therefor it may be useful to equalize the production amongst all the production zones. One way to equalize the production of the various production zones is to introduce a pressure drop at those zones which are producing more than other zones.

Figure 7:
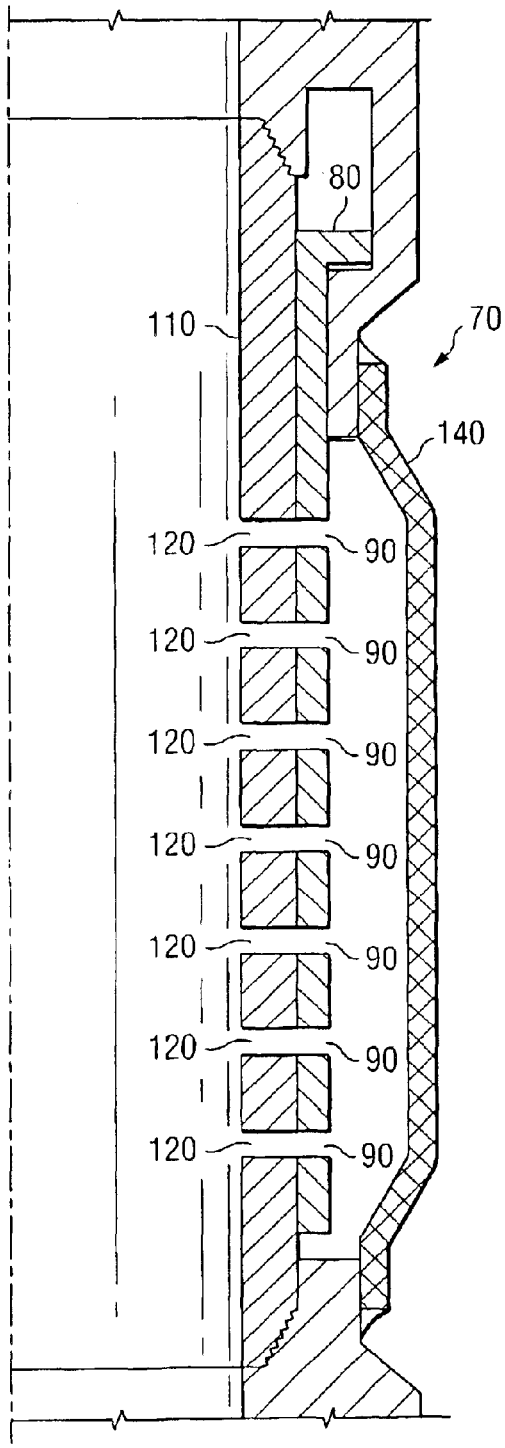
FIG. 7 is a one-half cross-sectional views of a well screen assembly illustrating a moveable outer tubular section according to another embodiment of the present invention.

FIG. 7 shows another embodiment of the invention. Once again a screen jacket 140 is shown. However, now the outer tubular section 80 is moveable relative to the stationary inner tubular section 110. The embodiment is shown with openings 120 and 90 aligned to form passageways. However, if the outer tubular section 80 is moved, the openings 120 and 90 will no longer be completely aligned.

Outer tubular section may be moved linearly in an upward direction, or may be rotated. In addition, the outer tubular section 80 may be moved helically, that is rotated and moved in an upward or downward direction to change the alignment between openings 120 and 90. When the outer tubular section is moved and the inner tubular section is stationary, the outer tubular is said to move "without" the inner tubular section, as contrasted with the situation where the inner tubular section moves "within" the outer tubular section.

In short, the inner tubular section 110 of both embodiments shown in FIGS. 3 and 4 may be either linearly moveable or rotatable in increments, such that the well screen assembly 70 may be used to incrementally control the flow of fluid from no-flow (corresponding to a fully closed position), to partial flow (corresponding to a partially open position), to full flow (corresponding to a fully opened position). In the fully opened position the plurality of holes 90 and 120 of both the inner tubular section 110 and outer tubular section 80 are in complete alignment. Further, both embodiments of the well screen assembly 70 may be configured so that the inner tubular section 110 may be moved, either in a linear or rotative fashion, with infinite adjustment between a fully blocked position and a position where the plurality of holes 90 and 120 are in complete alignment. In addition, but not shown, the outer tubular section 80 may be moved helically, that is rotated and moved in an upward or downward direction to change the alignment between openings 120 and 90.

Figure 8:
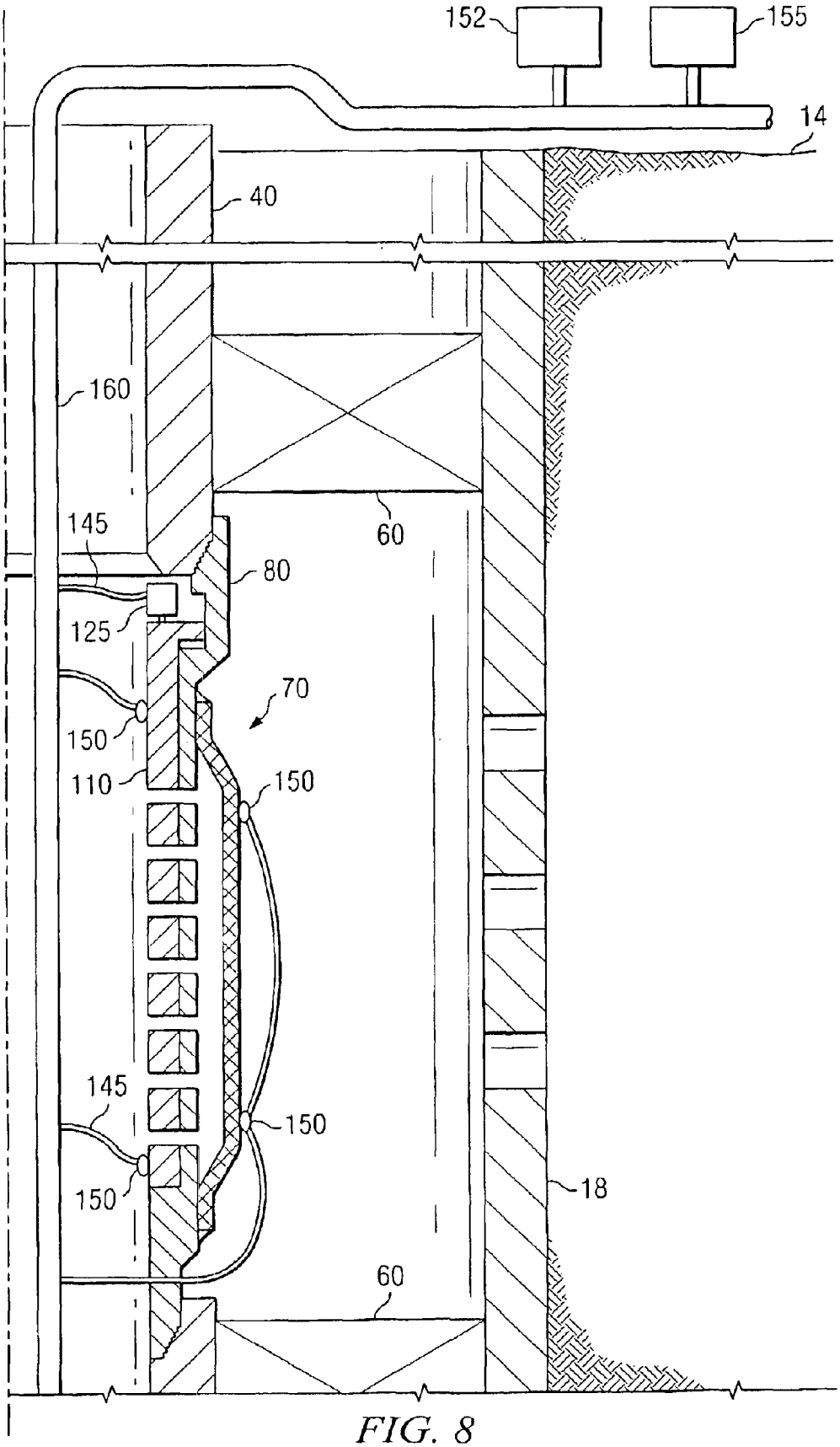
FIG. 8 is a partial cross-sectional view of a down-hole operation for extracting fluids such as crude oil from a plurality of production zones intersected by a wellbore with a well screen assembly according to the invention.

Referring now to FIG. 8, another embodiment of a well screen assembly according to the invention is shown. Similar to FIGS. 1 and 2, a casing wall 18 is shown. Packers 60 are shown between the casing 18 and the production tubing 40. Between the packers 60, is the well screen assembly 70. The well screen assembly 70 comprises an actuator 125 that is operatively coupled to the inner tubular section 110 and can thereby move the inner tubular section 110 relative to the outer tubular section 80. The actuator 125 is communicably coupled to a down-hole umbilical 160 using, for example, a coupling 145. Umbilicals of this sort are well known in the art. The umbilical 160, in turn, may be communicably coupled to a flow control device 152 on the surface 14. The actuator 125 is operatively coupled to the inner tubular section 110 to cause movement of at least one tubular section. The actuator 125 may receive power from a power supply 155 at the surface 14 via the umbilical 160.

FIG. 8 also shows the use of transducers 150 which allow the measurement of various conditions in the wellbore 12 including production fluid temperature, production fluid flow rate, and/or pressure. Transducers 150 are shown coupled to the umbilical 160 via couplings 145. Thus, the flow control device 152 may receive, via the umbilical 160, signals from the transducers 150 which represent measurement made within the wellbore 12. The measurements can be used by the flow control device 152 in calculating an amount of movement to be applied to the at least one tubular section for varying fluid flow through the well screen assembly 70 as a function of various conditions in the well. The actuator 125 may receive signals from the flow control device 152 via the umbilical 160. These control signals communicate to the actuator 125 the amount of movement of the inner tubular section 110.

In another embodiment of the invention, rather than a flow control device 152 calculating an amount of movement, an operator or engineer (not shown) at the surface 14 may review the transducer signals received at the flow control device 152. The operator or engineer may determine the proper movement for the at least one tubular section based on the transducer signals, among other factors, and then transmit signals via the flow control device through the umbilical 160 to the actuator 125.

In another embodiment of the invention, a wireline (also known as a slickline), may be used to move the at least one tubular section.

In yet another embodiment of the invention, a conductor line (also known as an electric wireline), instead of an umbilical 160, may be used to transmit signals from the transducers 150 up to the surface 14 for an operator or engineer to analyze. An operator or engineer at the surface 14 may review the transducer signals received at the flow control device 152. The operator or engineer may determine the proper the movement for the at least one tubular section based on the transducer signals, among other factors, and then transmit signals via the electric wireline to the actuator 125.

In still another embodiment of the invention, a hydraulic line, instead of an umbilical 160, may be used to transmit signals from the transducers 150 up to the surface 14 for an operator or engineer to analyze. An operator or engineer at the surface 14 may review the transducer signals received at the flow control device 152. The operator or engineer may determine the proper the movement for the at least one tubular section based on the transducer signals, among other factors, and then transmit signals via the hydraulic line to the actuator 125.

In still another embodiment of the invention, wireless telemetry, instead of an umbilical 160, may be used to transmit signals from the transducers 150 up to the surface 14. The control signals may be transmitted via wireless telemetry to the to the actuator 125.

Figure 9:
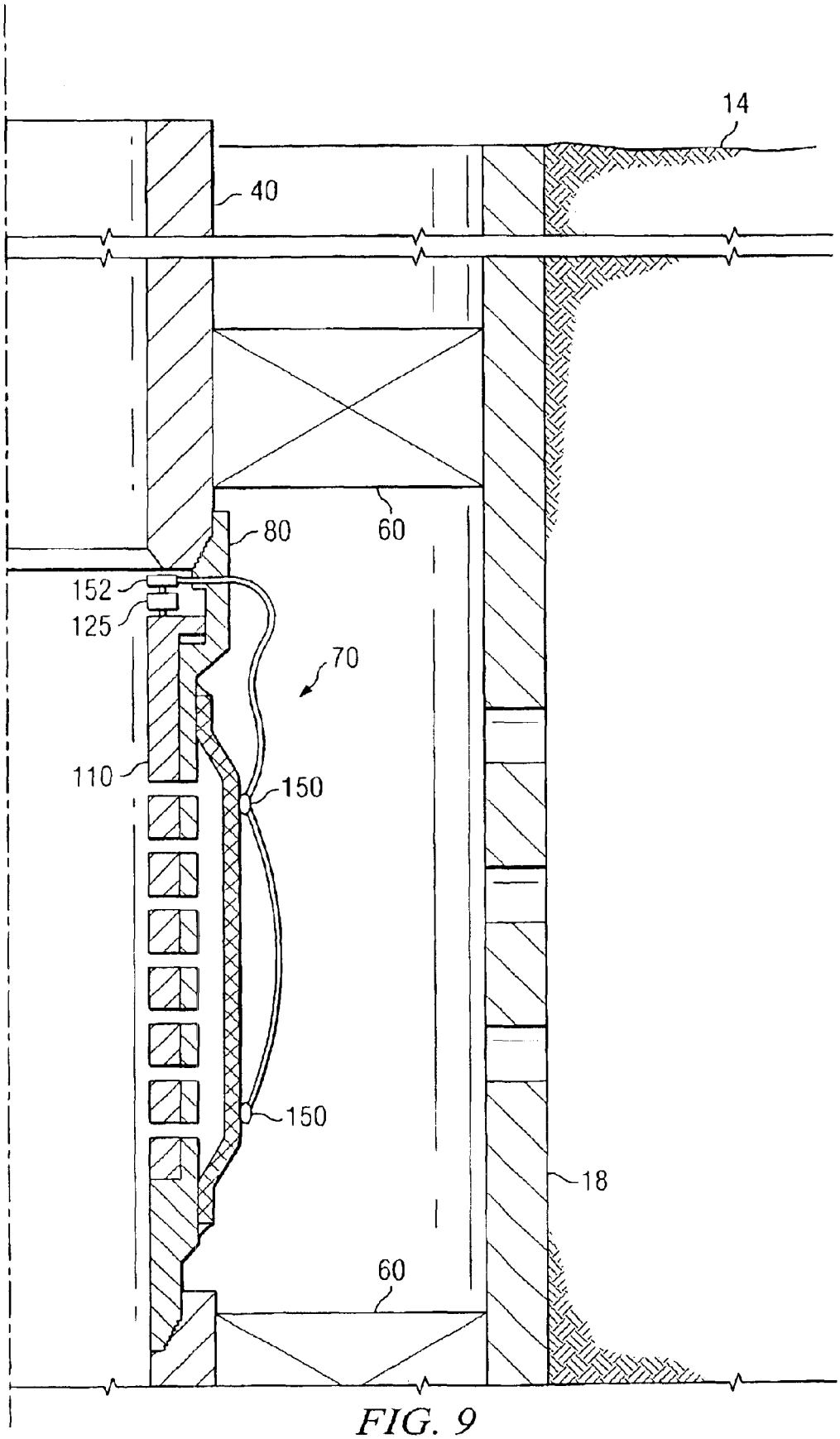
FIG. 9 is a partial cross-sectional view of a down-hole operation for extracting fluids such as crude oil from a plurality of production zones intersected by a wellbore with another embodiment of the well screen assembly according to the invention.

Referring now to FIG. 9, another embodiment of the invention is shown. In this embodiment a flow control device 152 is down-hole with the actuator 125. As before, transducers 150 may be used to measure various properties including fluid temperature, production fluid flow rate, or pressure. The transducers 150 are shown communicably coupled to the flow control device 152 in the wellbore. Thus, the flow control device 152 may receive signals from transducers 150 and the signals, in turn, are used to calculate an amount to motion to be applied to the inner tubular section 110 for achieving controlled and variable fluid flow control. The flow control device 152 may then communicate a control signal to the actuator 125 which makes the actuator 125 move the inner tubular section 110 according to the amount calculated. Power may be supplied to the flow control device 152, actuator 125 and transducers 150 by surface power, or down-hole power such as, for example, batteries or down-hole power generation devices.

Figure 10:
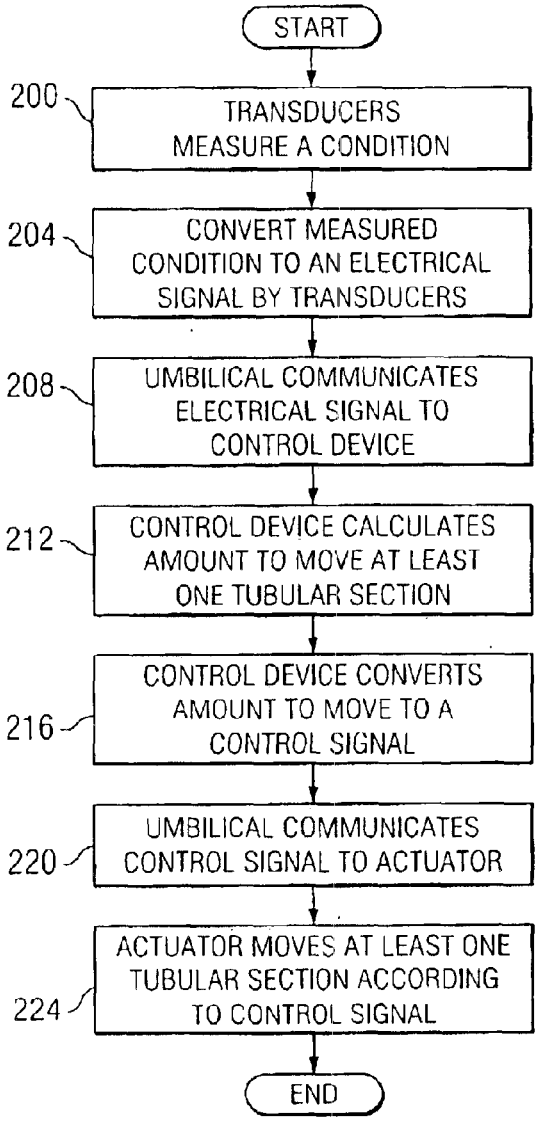
FIG. 10 illustrates a method for varying the flow area of a well screen assembly in a production fluid extraction operation having production tubing in a down-hole wellbore.

Referring now to FIG. 10, a process flow diagram for a method of varying the flow area of a well screen assembly 70 in a production fluid extraction operation having production tubing 40 in a down-hole wellbore 12 is shown. In step 200, transducers, such as transducer 150, measure one or more conditions in the well such as pressure, temperature or current flow rate of the production fluid. In step 204, the transducers 150 convert the measured condition into an electrical signal. At step 208, the electrical signal is communicated via an umbilical 160 to a flow control device 152 and, at step 212, the flow control device 152 calculates an amount of movement of the at least one tubular section necessary to achieve a desire level of flow control. At step 216, the flow control device 152 converts the calculated amount movement into a control signal which is communicated, at step 220, by the umbilical 160 to actuator 125. At step 224, the actuator 125 causes the movement of the at least one tubular section according to the control signal thereby allowing the variable control of production fluid flow through the well screen assembly 70.

Figure 11:
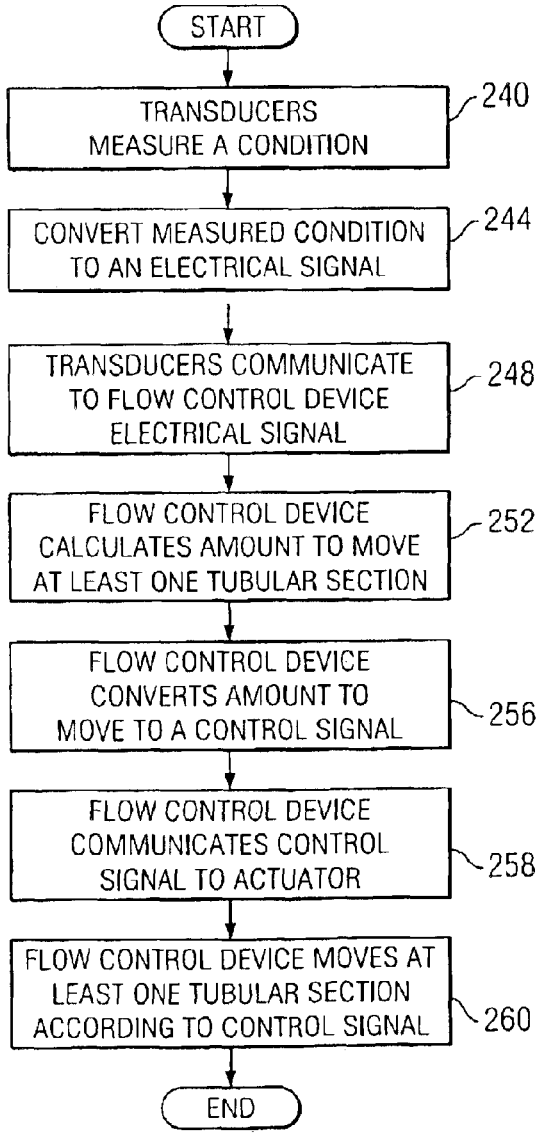
FIG. 11 illustrates another method for varying the flow area of a well screen assembly in a production fluid extraction operation having production tubing in a down-hole wellbore.

Referring now to FIG. 11, another method for varying the flow area of a well screen assembly 70 in a production fluid extraction operation having production tubing 40 in a down-hole wellbore 12 is disclosed. In step 240, transducers 150 measure a condition such as the pressure, temperature, or flow rate of the production fluid. In step 244, the transducers 150 convert the measured condition into an electrical signal which, in turn, is communicated at step 248, to flow control device 152. At step 252, the flow control device 152 calculates an amount of movement of the at least one tubular section corresponding to the desired flow rate. At step 256, the flow control device 152 converts the amount of movement of the at least one tubular section into a control signal. At step 258, the flow control device 152 communicates the control signal to the actuator 125 which causes the movement of the inner tubular section 110 according to the control signal, step 260, thereby controlling the flow rate of the production fluid through the well screen assembly 70.

Figure 12:
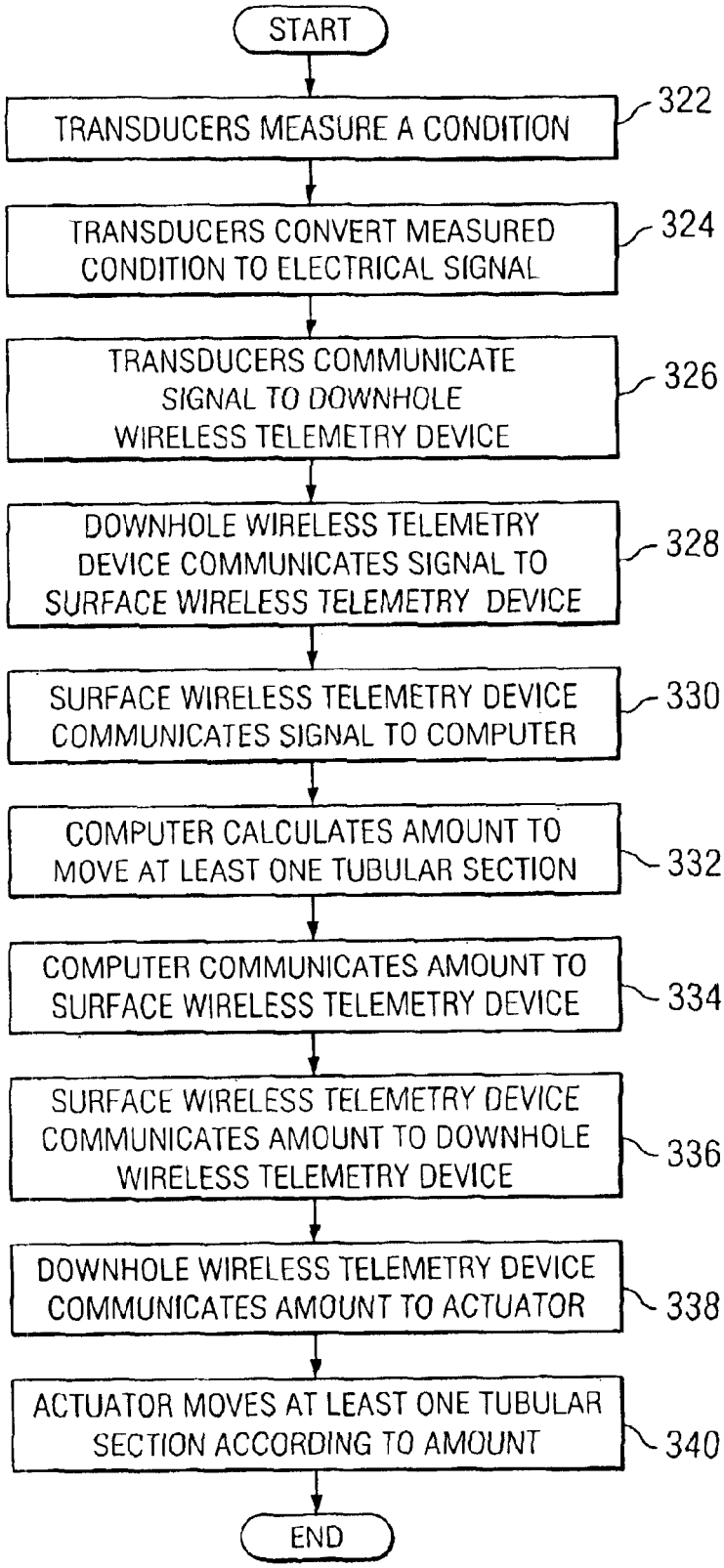
FIG. 12 illustrates another method for varying the flow area of a well screen assembly in a production fluid extraction operation having production tubing in a down-hole wellbore.

Referring now to FIG. 12, another method for varying the flow area of a well screen assembly 70 in a production fluid extraction operation having production tubing 40 in a down-hole wellbore 12 is disclosed. In step 322, transducers 150 measure a condition such as the pressure, temperature, or flow rate of the production fluid. In step 324, the transducers 150 convert the measured condition into an electrical signal. At step 326 the transducers communicate the electrical signal to a down-hole wireless telemetry device. At step 328, the down-hole wireless telemetry device communicates the signal to a surface wireless telemetry device. At step 330, the surface wireless telemetry device communicates the signal to a computer. At step 332 the computer calculates the amount to move the inner tubular section 110. At step 334 the computer communicates the amount it calculated to the surface wireless telemetry device. At step 336 the surface wireless telemetry device communicates the amount to the down-hole wireless telemetry device. At step 338 the down-hole wireless telemetry device communicates the amount to the actuator 125. At step 340 the actuator 125 moves the at least one tubular section according to the amount calculated.

In another embodiment of the invention, an operator or engineer may perform the calculations at step 332 of FIG. 11, and decide how much if any to move the at least one tubular section, instead of the computer making the calculations automatically.

The embodiments shown and described above are only exemplary. Even though numerous characteristics and advantages of the present invention have been set forth in the foregoing description together with details of the invention, the disclosure is illustrative only and changes may be made within the principles of the invention. It is therefore intended that such changes be part of the invention and within the scope of the following claims.

What is claimed is:

1. A well screen assembly with a controllable variable flow area, the well screen assembly comprising:

an outer tubular section having a first plurality of openings disposed in a pattern throughout a length of said outer tubular section;

an inner tubular section disposed within said outer tubular section, said inner tubular section having a second plurality of openings disposed throughout a length of said inner tubular section so that said openings may align to form a plurality of passageways that vary in size from a maximum overall opening to a closed position depending on the amount of overlap between said first plurality of openings and second plurality of openings;

an actuator operatively coupled to at least one tubular section;

at least one transducer communicatively coupled to said actuator; and wherein said actuator imparts motion to said at least one tubular section to vary fluid flow through said passageways by moving said at least one tubular section to change the amount of overlap between said first plurality of openings and said second plurality of openings responsive to changes measured by said at least one transducer.

2. The well screen assembly of claim 1, wherein said at least one tubular section may be moved to a position wherein said second plurality of openings align with said first plurality of openings.

3. The well screen assembly of claim 1, wherein said at least one tubular section may be moved to a position wherein said second plurality of openings partially align with said first plurality of openings.

4. The well screen assembly of claim 1, wherein said at least one tubular section may be moved to a position wherein said second plurality of openings do not align with said first plurality of openings.

5. The well screen assembly of claim 1, wherein said inner tubular section is linearly moveable within said outer tubular section.

6. The well screen assembly of claim 1, wherein said inner tubular section is rotatable within said outer tubular section.

7. The well screen assembly of claim 1, wherein said inner tubular section is helically moveable within said outer tubular section.

8. The well screen assembly of claim 1, wherein said outer tubular section is linearly moveable without said inner tubular section.

9. The well screen assembly of claim 1, wherein said outer tubular section is rotatable without said inner tubular section.

10. The well screen assembly of claim 1, wherein said outer tubular section is helically moveable without said inner tubular section.

11. The well screen assembly of claim 1, further comprising a screen jacket coupled to said outer tubular section.

12. The well screen assembly of claim 11, wherein said screen jacket is a wire-wrapped jacket.

13. The well screen assembly of claim 11, wherein said screen jacket is a dual-screen prepack screen jacket.

14. The well screen assembly of claim 11, wherein said screen jacket comprises a sintered laminate filter media and a protective shroud.

15. The well screen assembly of claim 1, wherein said at least one tubular section may be incrementally moved between a first position where said second plurality of openings do not align with said first plurality of openings and a final position where said second plurality of openings completely align with said first plurality of openings.

16. The well screen assembly of claim 1, wherein said at least one tubular section may be moved with infinite adjustment between a first position where said second plurality of openings do not align with said first plurality of openings and a final position where said second plurality of openings align with said first plurality of openings.

17. The well screen assembly of claim 1 further comprising:

a third plurality of openings disposed throughout a length of at least one of said tubular sections, and each opening of said third plurality of openings forms a tortuous passageway.

18. The well screen assembly of claim 1, further comprising:

a flow control device operatively coupled to said actuator and communicatively coupled to said at least one transducer; and wherein said at least one tubular section moves an amount proportional to changes measured by said at least one transducer.

19. The well screen assembly of claim 18, wherein said at least one transducer is a transducer selected from the group consisting of pressure transducer, temperature transducer, and flow rate transducer.

20. A system for extracting production fluid from at least one production zone intersected by a wellbore, the system including at least one well screen assembly comprising:

production tubing extending along a substantial length of the wellbore, the production tubing including at least one well screen assembly located proximate to each of said at least one production zone;

said at least one well screen assembly comprising:

an outer tubular section, said outer tubular section containing a first plurality of openings disposed in a pattern throughout a length of said outer tubular section;

an inner tubular section that is disposed within said outer tubular section, said inner tubular section containing a second plurality of openings disposed in said pattern throughout a length of said inner tubular section;

an actuator operatively coupled to at least one tubular section;

at least one transducer communicatively coupled to said actuator; and wherein said actuator imparts motion to said at least one tubular section to vary fluid flow through said at least one well screen assembly by moving said at least one tubular section to change the amount of overlap between said first plurality of openings and said second plurality of openings responsive to changes measured by said at least one tranducer.

21. The system of claim 20, wherein said at least one well screen assembly may vary the flow of production fluid through it and upwards through the interior of said production tubing.

22. The system of claim 20, wherein the well screen assembly may restrict flow from the production tubing back into the at least one productions zone.

23. The system of claim 20 further comprising:

a flow control device operatively coupled to said actuator and communicatively coupled to said at least one transducer; and wherein the production fluid screening system is able to vary its flow area by moving said at least one tubular section via said actuator by an amount proportional to control signals received from said flow control device, said control signals calculated at said flow control device from transducer signals transmitted by said at least one transducer.

24. The system of claim 23, where said inner tubular section is linearly moveable within said outer tubular section.

25. The system of claim 23, where said inner tubular section is rotatable within said outer tubular section.

26. The system of claim 23, where said inner tubular section is helically moveable within said outer tubular section.

27. The system of claim 23, where said outer tubular section is linearly moveable without said inner tubular section.

28. The system of claim 23, where said outer tubular section is rotatable without said inner tubular section.

29. The system of claim 23, where said outer tubular section is helically moveable without said inner tubular section.

30. The system of claim 23, where a third plurality of openings is disposed throughout a length of at least one of said tubular sections, and each opening of said third plurality of openings form a tortuous passageway.

31. The system of claim 23, wherein said transducer is a temperature transducer.

32. The system of claim 23, wherein said transducer is a pressure transducer.

33. The system of claim 23, wherein said transducer is a flow rate transducer.

34. A method for varying the flow area of a well screen assembly in a production fluid extraction operation having production tubing in a down-hole wellbore, the method comprising:

measuring a condition of the production fluid by at least one transducer;

converting the measured condition into an electrical signal by said least one transducer;

transmitting said electrical signal to a flow control device by an umbilical;

calculating an amount of movement based on said electrical signal by said flow control device;

converting said amount of movement into a control signal by said flow control device;

transmitting said control signal to an actuator by said umbilical; and moving, by said actuator, a first tubular section containing a plurality of openings disposed in a pattern relative to a second tubular section containing a plurality of openings disposed in said pattern, thereby varying the flow area of the well screen assembly for the transmission of production fluid upwards through the interior of the production tubing.

35. The method of claim 34, wherein said condition is temperature.

36. The method of claim 34, wherein said condition is pressure.

37. The method of claim 34, wherein said condition is flow rate.

38. A method for varying the flow area of a well screen assembly in a production fluid extraction operation having production tubing in a down-hole wellbore, the method comprising:

measuring a condition of the production fluid by at least one transducer;

converting the measured condition into an electrical signal by said least one transducer;

communicating said electrical signal to a down-hole wireless telemetry device;

communicating said electrical signal from said down-hole wireless telemetry device to a surface wireless telemetry device;

communicating said electrical signal from said surface wireless telemetry device to a computer;

calculating, by the computer, an amount to move at least one tubular section;

communicating, by the computer, said amount to said surface wireless telemetry device;

communicating said amount from said surface wireless telemetry device to said down-hole wireless telemetry device;

communicating said amount from said down-hole wireless telemetry device to an actuator; and moving, by said actuator, at least one tubular section according to said amount.

39. A method for varying the flow area of a well screen assembly in a production fluid extraction operation having production tubing in a down-hole wellbore, the method comprising:

measuring a condition of the production fluid by at least one transducer;

converting the measured condition into an electrical signal by said least one transducer;

communicating said electrical signal to a down-hole wireless telemetry device;

communicating said electrical signal from said down-hole wireless telemetry device to a surface wireless telemetry device;

communicating said electrical signal from said surface wireless telemetry device to an operator, calculating, by said operator, an amount to move at least one tubular section;

communicating said amount to said surface wireless telemetry device;

communicating said amount from said surface wireless telemetry device to said down-hole wireless telemetry device;

communicating said amount from said down-hole wireless telemetry device to an actuator; and moving, by said actuator, at least one tubular section according to said amount.

* * * * *